US012516832B2

(12) United States Patent
Hiroishi et al.

(10) Patent No.: US 12,516,832 B2
(45) Date of Patent: Jan. 6, 2026

(54) AIR CONDITIONING VENTILATION SYSTEM

(71) Applicant: FH alliance Inc., Kasugai (JP)

(72) Inventors: Kazuro Hiroishi, Kasugai (JP); Mitsunori Matsubara, Kasugai (JP)

(73) Assignee: FH ALLIANCE INC., Kasugai (JP)

( * ) Notice: Subject to any disclaimer, the term of this patent is extended or adjusted under 35 U.S.C. 154(b) by 553 days.

(21) Appl. No.: 17/784,060

(22) PCT Filed: Dec. 9, 2020

(86) PCT No.: PCT/JP2020/045873
§ 371 (c)(1),
(2) Date: Jun. 9, 2022

(87) PCT Pub. No.: WO2021/117768
PCT Pub. Date: Jun. 17, 2021

(65) Prior Publication Data

US 2023/0040056 A1 Feb. 9, 2023

(30) Foreign Application Priority Data

Dec. 13, 2019 (JP) ..... 2019-225554

(51) Int. Cl.
*F24F 7/08* (2006.01)
*F24F 11/65* (2018.01)
(Continued)

(52) U.S. Cl.
CPC ..... *F24F 7/08* (2013.01); *F24F 11/65* (2018.01); *F24F 13/222* (2013.01); *F24F 2110/12* (2018.01); *F24F 2110/20* (2018.01)

(58) Field of Classification Search
CPC .. F24F 7/08; F24F 11/65; F24F 13/222; F24F 2110/12; F24F 2110/20
(Continued)

(56) References Cited

U.S. PATENT DOCUMENTS 8,364,318 B2 * 1/2013 Grabinger ..... F24F 11/77 454/333
2014/0106660 A1 * 4/2014 Salerno ..... F24F 11/74 454/239
(Continued)

FOREIGN PATENT DOCUMENTS

EP 2345855 A1 * 7/2011 ..... F24F 12/006
JP H07-158899 A 6/1995
(Continued)

OTHER PUBLICATIONS

International Search Report for International Application No. PCT/JP2020/045873 dated Jan. 26, 2021 (3 sheets).

*Primary Examiner* — Avinash A Savani
*Assistant Examiner* — Dana K Tighe
(74) *Attorney, Agent, or Firm* — Kratz, Quintos & Hanson, LLP

(57) ABSTRACT

An air conditioning ventilation system comprising: air-intake portions 123 and exhaust portions 124 respectively provided in a plurality of rooms of a building; air-blowing sections 103 for sending wind to the air-intake portions 123; and a return zone 101 where air discharged from the exhaust portions 124 by the air-blowing sections 103 joins up; wherein the air-blowing sections 103 and an air conditioning section are placed in the return zone 101, a bathroom 106 and other rooms include ventilation intake portions 125 and ventilation exhaust section 126*s* to ventilate these room for exchanging air, the system includes a heat exchanging unit 111 which heat-exchanges confluence air of the plurality of rooms and the bathroom 106 and outside air, and discharges the air to outside of the rooms, and the outside air after the outside air exchanges heat with the confluence air is introduced into the return zone 101. The present invention provides the air conditioning ventilation system which prevents lifetime of the system from being shortened by dew
(Continued)

condensation of a heat exchanging element while recovering heat during bath time, which prevents mold in the bathroom 106 by ventilation of the bathroom 106 for 24 hours, and which can always realize comfortable clean air living at all times by flow of air-conditioning air and flow of ventilation air in an entire house while saving energy.

6 Claims, 5 Drawing Sheets

(51) Int. Cl.
*F24F 13/22* (2006.01)
*F24F 110/12* (2018.01)
*F24F 110/20* (2018.01)

(58) Field of Classification Search
USPC ..... 454/239
See application file for complete search history.

(56) References Cited

U.S. PATENT DOCUMENTS

| | | | | |
|---|---|---|---|---|
| 2015/0285524 | A1* | 10/2015 | Saunders | F24F 11/62 454/239 |
| 2019/0145642 | A1* | 5/2019 | Heigl | F24F 13/10 454/239 |
| 2020/0292198 | A1* | 9/2020 | Funada | F24F 3/001 |

FOREIGN PATENT DOCUMENTS

| | | | | |
|---|---|---|---|---|
| JP | 2002-257380 | A | 9/2002 | |
| JP | 2005-188885 | A | 7/2005 | |
| JP | 2006-046685 | A | 2/2006 | |
| JP | 2009121793 | A * | 6/2009 | F24F 12/003 |
| JP | 2011-174674 | A | 9/2011 | |

* cited by examiner

[Fig. 1]
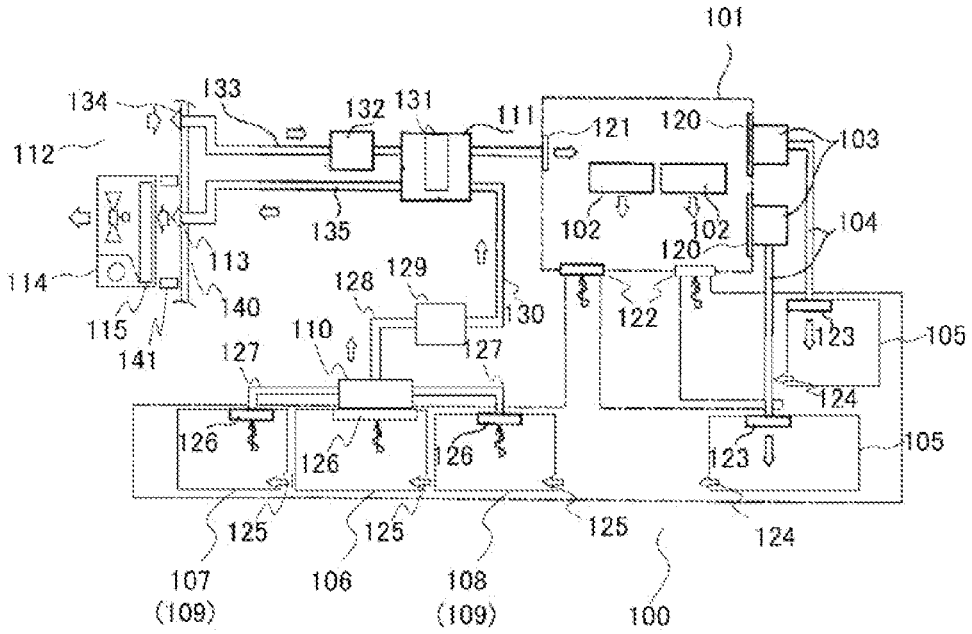

[Fig. 2]
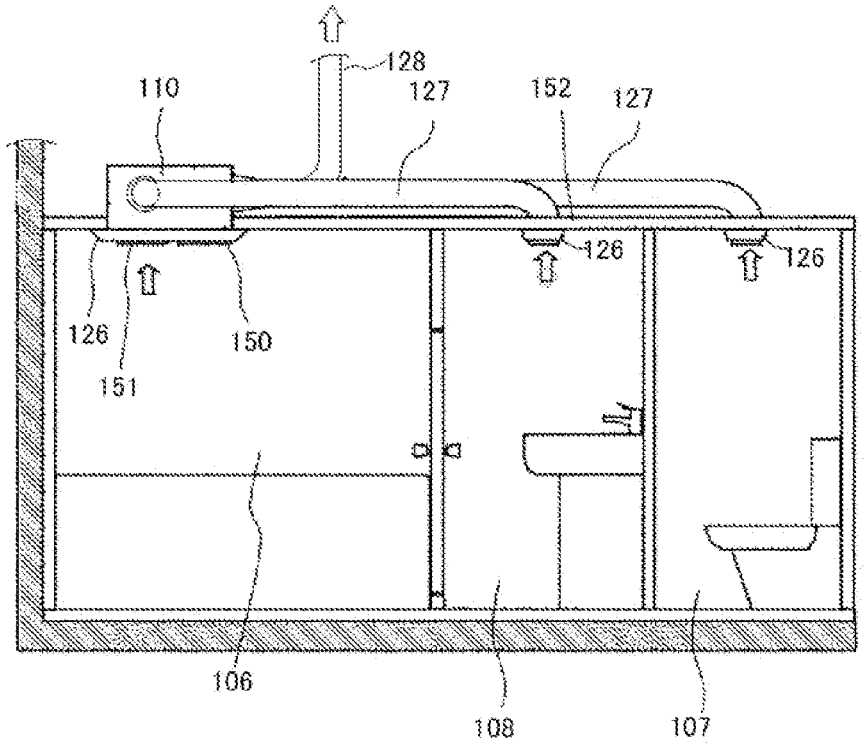

[Fig. 3]
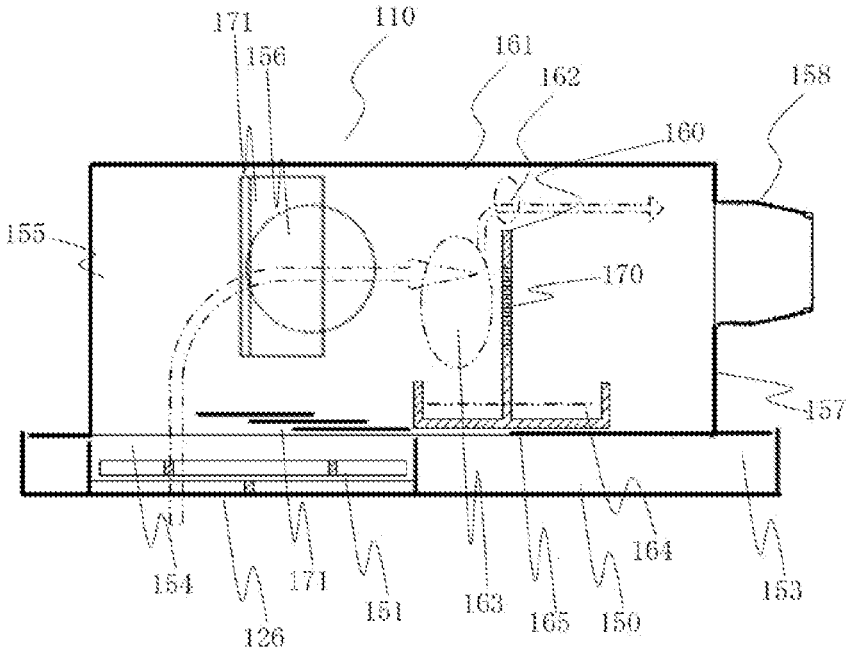

[Fig. 4]
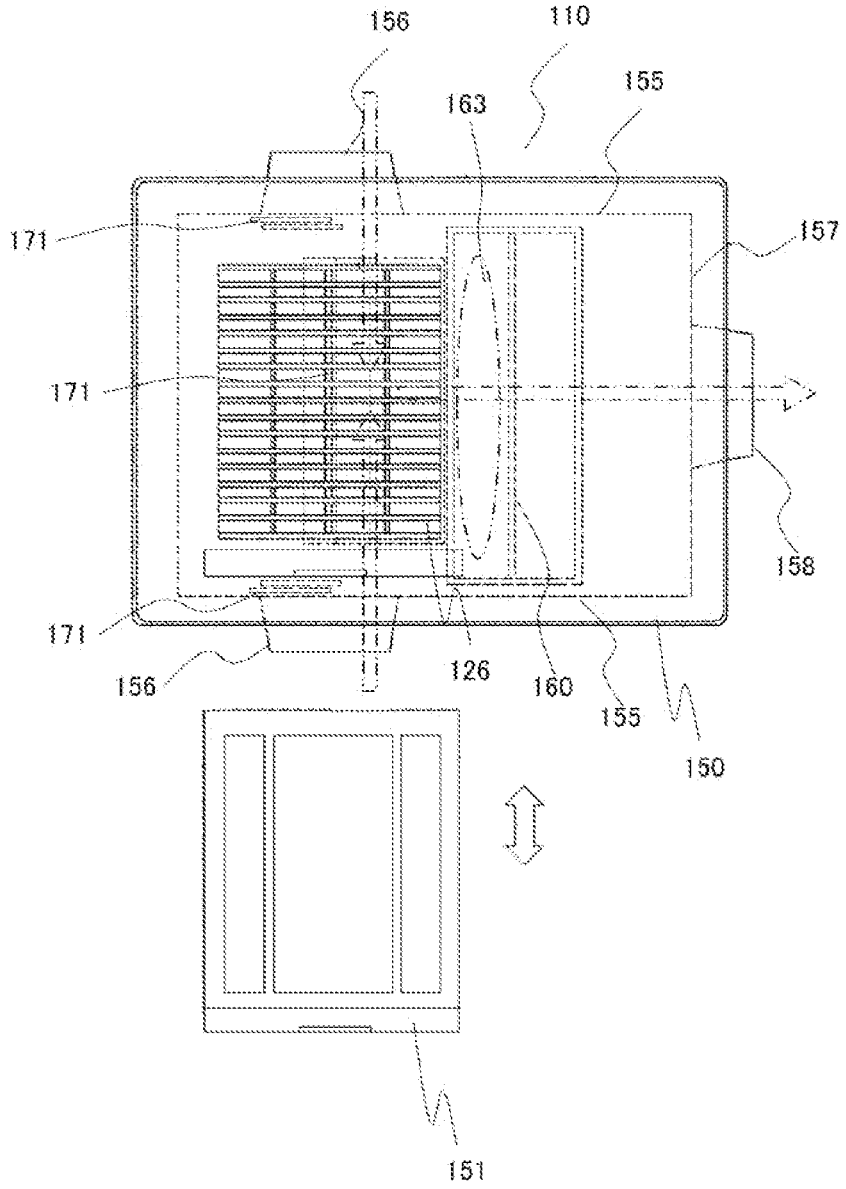

[Figs. 5]
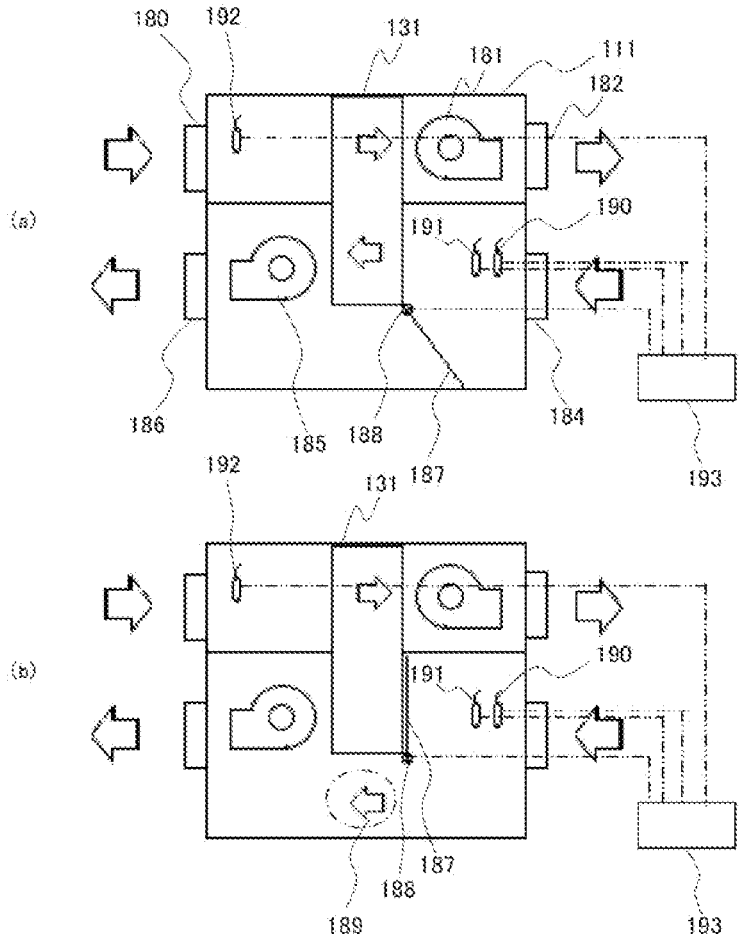

AIR CONDITIONING VENTILATION SYSTEM

TECHNICAL FIELD

The present invention relates to an air conditioning ventilation system for air conditioning a plurality of rooms in a building by an air conditioning section and an air-blowing section, and for ventilating the rooms by a heat exchanging unit.

BACKGROUND TECHNIQUE

To realize energy-saving and comfort living, airtightness and heat insulating performance of a house have progressed. On the other hand, to clean the air and to realize healthy living, importance of ventilation is growing.

Conventionally, as an air conditioning ventilation system of this kind, there is known a system in which an air conditioner chamber is provided in a building, air sucked into the air conditioner chamber is adjusted in temperature by an air conditioner, the air is sent to a plurality of rooms by a plurality of air-blowing sections and the air is air-conditioned, and ventilation air from under a floor or utility in which a washing machine, a dryer, a clothes iron and the like are collectively placed is heat-exchanged with outside air by a heat exchanging unit, and the air is discharged (see patent document 1 for example).

As a heat recovery type ventilation system, there is known a system in which ventilation air from a bathroom passes through a branch box from a bathroom heating/drying device provided in the bathroom, and exchanges heat with outside air by a sensible heat-exchange ventilation unit, and the air is discharged (see patent document 2 for example).

Further, as a heat exchanging ventilation system, there is known a system in which a bathroom exhaust duct through which air in a bathroom passes is connected to an exhaust passage on the lee side of all of heat exchangers (see patent document 3 for example).

As a ventilation air conditioning system, there is known a system in which an air conditioning device and a ventilation device having a heat exchanging ventilation mode and a normal ventilation mode are controlled by calculating indoor enthalpy and outdoor enthalpy from indoor temperature, indoor humidity, outdoor temperature and outdoor humidity (see patent document 4 for example).

Further, as an air conditioning ventilation system, there is known a system in which after heat of ventilation air from a bathroom or a restroom is exchanged with outside air by a heat exchanger, the air is discharged to an air supply side of an outdoor unit of an air conditioning device (see patent document 5 for example).

PRIOR ART DOCUMENTS

Patent Documents

[Patent Document 1] Japanese Patent No. 5094894

[Patent Document 2] Japanese Patent Application Laid-open No. 2002-168503

[Patent Document 3] Japanese Patent No. 3959182

[Patent Document 4] Japanese Patent No. 6156245

[Patent Document 2] Japanese Patent Application Laid-open No. 2006-112684

SUMMARY OF THE INVENTION

Problem to be Solved by the Invention

However, according to the air conditioning ventilation system described in patent document 1, since heat of ventilation air from a bathroom is recovered, if the ventilation air from the bathroom enters the heat exchanging unit, a total heat exchanging element condenses due to high temperature and high humidity ventilation air during bath time in winter. Therefore, there is a problem that the total heat exchanging element is deteriorated in its performance and its lifetime is shortened.

In the case of the sensible heat exchanging element of the heat recovery type ventilation system described in patent document 2 also, lifetime of the heat exchanging element is shortened due to dew condensation. In the heat recovery type ventilation system described in patent document 2, it is necessary to connect the system to a drainage hose through which dew condensation water flows and to a drainage port. Further, the sensible heat exchanging element has a problem that heat exchanging efficiency is inferior to the total heat exchanging element.

According to the heat exchanging ventilation system described in patent document 3, since ventilation air of a bathroom passes through a downstream side of the heat exchanging element, there is a problem that heat cannot be recovered.

According to the ventilation air conditioning system described in patent document 4, since control is performed such that enthalpy is brought close to comfortable indoor target enthalpy, a problem that the total heat exchanging element is condensed is not solved.

According to the air conditioning ventilation system described in patent document 5, since ventilation air from a bathroom passes through the heat exchanging element, a problem of dew condensation is generated.

The present invention has been achieved to solve such conventional problems, and it is an object of the invention to provide an air conditioning ventilation system in which it is possible to prevent lifetime of a heat exchanging element from being shortened due to dew condensation while recovering heat during bath time, air conditioning air and air in the bathroom are replaced by ventilation during 24 hours in the bathroom, humidity in the bathroom is lowered, mold in the bathroom is prevented, and it is possible to realize always comfortable, clean air and energy saving living by flowing of the air conditioning air and the ventilation air in an entire housing.

Means for Solving the Problem

To achieve the above object, an air conditioning ventilation system of the present invention includes air-intake portions and exhaust portions respectively provided in a plurality of rooms of a building; air-blowing sections for sending wind to the air-intake portions; and a return zone where air discharged from the exhaust portions by the air-blowing sections joins up; the air-blowing sections and an air conditioning section are placed in the return zone, a bathroom and other rooms include ventilation intake portions and ventilation exhaust sections to ventilate these room for exchanging air, the system includes a heat exchanging unit which heat-exchanges confluence air of the plurality of rooms and the bathroom and outside air, and discharges the air to outside of the rooms, and the outside air after the outside air exchanges heat with the confluence air is introduced into the return zone.

According to this means, fresh air from the heat exchanging unit and return air after the air conditioning are air-conditioned by the air conditioning section in the return zone, the air-conditioned air is sent to a plurality of rooms by the air-blowing section, and the rooms are air-conditioned. A portion of the air after the air conditioning is sent to the bathroom and the other rooms, the air in the bathroom and air in the other rooms are replaced, and the air in the bathroom and the air in the other rooms are exhausted. The air in the bathroom and the air in the other rooms join together and are mixed. Therefore, relative humidity of air after confluence becomes lower than relative humidity of air in the bathroom. The air after confluence whose relative humidity is lowered flows into the heat exchanging unit, exchanges heat with outside air and is exhausted to outside of the room. Hence, heat of the bathroom especially during bath time can be recovered, dew condensation of the heat exchanging element is reduced, it is possible to prevent the lifetime thereof from being shortened, and it is possible to prevent mold in the bathroom. Therefore, it is possible to provide an air conditioning ventilation system capable of realizing comfortable and clean air while saving energy.

According to another means, a sanitary such as a restroom and a lavatory, a storage room such as a clothes closet, or a kitchen is the other room.

According to this, a so-called sanitary such as the restroom and the lavatory is the other room. Therefore, air in a room such as the restroom and the lavatory having strong smell and humidity on a daily basis is made to join with air in the bathroom. Therefore, proportion of smell and humidity with respect to the confluence ventilation air is lowered, and the confluence air directly flows into the heat exchanging unit without through rooms. Hence, it is possible to recover more heat, reduce dew condensation of the total heat exchanging element, and it is possible to prevent the lifetime thereof from being shortened. Therefore, it is possible to provide an air conditioning ventilation system in which smell and humidity do not move into rooms.

In another means, the air conditioning ventilation system further includes a confluence chamber where ventilation air from the other room and ventilation air from the bathroom join together.

According to this, various ventilation air groups from the bathroom, the sanitary, the storage room and the kitchen join together in the confluence chamber having internal volume which is greater than a normal branch duct. Therefore, as the internal volume of the confluence chamber is greater, the proportional of smell and humidity with respect to the confluence ventilation air is lowered, dew condensation of the total heat exchanging element is reduced, and it is possible to prevent the lifetime thereof from being shortened. Hence, an air conditioning ventilation system having excellent workability can be obtained.

According to another means, an outlet portion of a bathroom ventilation fan provided in the bathroom is connected to a ventilation exhaust port of the ventilation air from the bathroom of the confluence chamber.

The outlet portion of the bathroom ventilation fan provided in the bathroom is connected to the ventilation exhaust port of the ventilation air from the bathroom of the confluence chamber through a duct. Therefore, if the air blower of the bathroom ventilation fan is operated, the ventilation air from the bathroom stably flows into the confluence chamber irrespective of resistance of the duct, the bathroom can be ventilated, and it is possible to select a place where the confluence chamber can easily be placed. Hence, an air conditioning ventilation system having excellent workability can be obtained.

According to another means, a ceiling of the bathroom or the other room is provided with the confluence chamber.

A ceiling of a sanitary such as a bathroom, a restroom and a lavatory, a storage room or a kitchen is provided with the confluence chamber. Therefore, a ventilation exhaust section of the bathroom, the sanitary, the storage room or the kitchen and the ventilation exhaust port of the confluence chamber can directly be connected to each other without through a duct. Hence, another ventilation fan is unnecessary irrespective of resistance of the duct, and it is possible to stably ventilate the bathroom, the sanitary, the storage room or the kitchen. Therefore, it is possible to obtain the air conditioning ventilation system 100 which can be maintained from under a ceiling of the bathroom, the sanitary, the storage room or the kitchen.

According to another means, the air conditioning ventilation system further includes a ventilation exhaust port of the ventilation air from the bathroom of the confluence chamber, and the ventilation exhaust port includes a filter.

According to this, it is possible to obtain the air conditioning ventilation system 100 capable of preventing moisture vapor having large air in the bathroom or chemical component included in the moisture vapor from flowing into the heat exchanging unit.

In another means, the air conditioning ventilation system further includes a wall portion provided on a halfway of a flow passage between the ventilation exhaust port of the ventilation air from the bathroom and an outlet portion of the confluence chamber in the confluence chamber.

According to this, it is possible to obtain the air conditioning ventilation system 100 capable of preventing relatively large moisture vapor in air after confluence or chemical component included in the moisture vapor from flowing into the heat exchanging unit.

In another means, a plurality of small holes are formed in the wall portion.

According to this, it is possible to obtain the air conditioning ventilation system 100 capable of preventing moisture vapor in air after confluence or chemical component included in the moisture vapor from flowing into the heat exchanging unit, in which pressure loss is small.

In another means, a lower portion of the wall portion is provided with a drain pan.

According to this, it is possible to obtain the air conditioning ventilation system 100 capable of preventing water droplet which adheres to the wall portion rom dropping in the bathroom.

In another means, a ventilation exhaust port of ventilation air from the bathroom or the other room of the confluence chamber includes air volume adjusting portions for adjusting air volume.

According to this, it is possible to obtain the air conditioning ventilation system 100 capable of adjusting air volume to ventilation air volume corresponding to a status of ventilation air of the bathroom, the sanitary, the storage room or the kitchen.

In another means, ventilation air volume of the bathroom is made equal to or less than ventilation air volume of the other room by the air volume adjusting portion.

According to this, it is possible to obtain the air conditioning ventilation system 100 which further reduces moisture in the bathroom during bath time which flows into the heat exchanging unit.

In another means, a distance between the ventilation exhaust port of the ventilation air from the bathroom of the confluence chamber and an outlet portion of the confluence chamber is longer than a distance between the ventilation exhaust port of the ventilation air from the other room and the outlet portion.

According to this, it is possible to obtain the air conditioning ventilation system 100 which reduces moisture in the bathroom during bath time up to the outlet portion.

In another means, a ceiling of the bathroom includes the confluence chamber, a bottom surface of the confluence chamber is provided with the ventilation exhaust port of the ventilation air from the bathroom, and a side surface of the confluence chamber is provided with the ventilation exhaust port of the ventilation air from the other room and an outlet portion of the confluence chamber.

According to this, it is possible to obtain the air conditioning ventilation system 100 capable of reducing moisture of confluence air in the bathroom even during bath time by flow of ventilation air in the confluence chamber.

In another means, a filter is provided between the confluence chamber and the heat exchanging unit.

According to this, it is possible to obtain the air conditioning ventilation system 100 in which ventilation air having low moisture and small chemical compound flows into the heat exchanging unit.

In another means, the heat exchanging unit includes a normal ventilation mode for making ventilation air bypass heat exchanging element, and a heat exchanging ventilation mode for making the ventilation air pass through the heat exchanging element, by a bypass damper.

According to this, it is possible to obtain the air conditioning ventilation system 100 which operates the heat exchanging unit in the normal ventilation mode during bath time in winter, and which can prevent lifetime of the system from being shortened by dew condensation onto the heat exchanging element.

In another means, the air conditioning ventilation system further includes: a moisture detecting section near a ventilation air inlet portion of the heat exchanging unit; an outside air temperature detecting section near an outside air inlet portion; and a control section for switching the bypass damper between the normal ventilation mode and the heat exchanging ventilation mode depending upon detection values of the moisture detecting section and the outside air temperature detecting section.

According to this, it is possible to obtain the air conditioning ventilation system 100 capable of changing the modes automatically.

In another means, an exhaust portion for discharging the ventilation air discharged from the heat exchanging unit to outside of the room is provided at a suction side position of a heat exchanger of an air conditioning outdoor machine.

According to this, it is possible to obtain a further energy-saving air conditioning ventilation system which further recovers heat which could not be recovered by the heat exchanging unit.

In another means, air volume of the air-blowing sections is greater than air volume of the air conditioning section and ventilation air volume of the heat exchanging unit.

According to this, it is possible to obtain the air conditioning ventilation system 100 in which fresh air is introduced, air including moisture and smell is exhausted and air-conditioned air efficiently stirs air in the entire house.

Effect of the Invention

The present invention prevents lifetime of the air conditioning ventilation system from being shortened by dew condensation of the heat exchanging element while recovering heat during bath time, and prevents mold in the bathroom by ventilation in the bathroom for 24 hours. Hence, it is possible to provide an air conditioning ventilation system in which air-conditioned air efficiently stirs air in the entire house, fresh air is introduced, air including moisture and smell is exhausted and therefore, it is possible to realize always comfortable and always clean air living while further saving energy.

Further, it is possible to provide an air conditioning ventilation system in which workability from the bathroom and maintenance is easy.

BRIEF DESCRIPTION OF THE DRAWINGS

FIG. 1 is a block diagram of an air conditioning ventilation system of an embodiment of the present invention;

FIG. 2 is a vertical sectional view of a sanitary of a building where the system is installed;

FIG. 3 is a vertical sectional view of a confluence chamber of the system;

FIG. 4 is a bottom view of the confluence chamber; and

FIG. 5 are horizontal sectional views of a heat exchanging unit of the system.

MODE FOR CARRYING OUT THE INVENTION

FIG. 1 is a block diagram of an air conditioning ventilation system of an embodiment of the present invention.

As shown in FIG. 1, an air conditioning ventilation system 100 is installed in a building (not shown) which is a high airtight and high heat insulating housing. The air conditioning ventilation system 100 air-conditions and ventilates a living space and a non-living space such as a plurality of rooms 105 divided in the building, a bathroom 106, a restroom 107, a lavatory 108, a kitchen (not shown), a loft (not shown), a hallway (not shown) and an underfloor (not shown). In this case, the living space is a room which is continuously used for purpose of living, working, operating, recreation and the like, and the non-living space is a room other than the former room, but when it is difficult to determine that the room is a living space, it should be determined in accordance with utilizing situation.

The plurality of zones of the living space and the non-living space can individually be set for each of buildings.

A return zone 101 is provided in a non-living space such as the loft, the underfloor, an understair (not shown), a footpace of stairs (not shown), and a machine room (not shown). The return zone 101 is provided therein with an outside air introducing port 121 for introducing outside air, air-blowing sections 103 having a plurality of suction ports 120, return ports 122 for introducing return air from the plurality of rooms 105, and a plurality of air conditioning sections 102 connected to an air conditioning outdoor machine 114 placed outside through a refrigerant pipe and an electric wire.

Air-intake portions 123 provided in ceiling of the plurality of rooms 105 which are living spaces and the air-blowing sections 103 are connected to each other through a plurality of ducts 104. Exhaust portions 124 such as undercut of doors of the rooms 105 are connected to a hallway which is a non-living space, stair hall (not shown), an entrance (not shown) or a duct (not shown), and they are connected to return ports 122 provided in the return zone 101.

In the above-described configuration, if the air conditioning sections 102 and the air-blowing sections 103 are operated, air in the return zone 101 which is air-conditioned by the air conditioning sections 102 is sent by the air-blowing sections 103 through the ducts 104, the air-conditioned air is blown out from the air-intake portions 123 of the plurality of rooms 105, and the rooms 105 are air-conditioned. The air after the air conditioning returns to the return zone 101 from the return ports 122 through the exhaust portions 124 of the rooms 105, the hallway, the stair hall, the entrance of the duct, and the air is air-conditioned by the air conditioning sections 102.

The air conditioning sections 102 include heat exchangers (not shown) connected to the air conditioning outdoor machine 114 through a refrigerant pipe and an air blower (not shown), and the air-blowing sections 103 includes a fan (not shown) and a motor (not shown).

In the present embodiment, an air blower in the return zone 101 is divided into an air blower of the air conditioning sections 102 and the air-blowing section 103, but if air-conditioning air blower performance for heat-exchanging by a heat exchanger and a transfer function for sending air to the rooms 105 are effectively exhibited, any configuration of the air blower can be employed.

In the embodiment, the return zone 101 is an air-conditioning chamber which is covered with a wall and heat insulation material and hermetically closed, but the return zone 101 may be a compact casing covered with metal plate or heat insulation material, and if air before air-conditioning and air after air-conditioning are not mixed due to a positional relation between the air conditioning sections 102 and the air-blowing sections 103, the return zone 101 may be a stair chamber, a hallway or a casing whose portion is opened.

The ventilation intake portions 125 such as undercuts of doors of the bathroom 106 and the sanitaries 109 are connected to the exhaust portions 124 of the plurality of rooms 105, the hallways, the stair hall or the entrance. The sanitaries 109 are the restroom 107 and the lavatory 108. The rooms 105 and the kitchen are living spaces. The bathroom 106, the restroom 107, the lavatory 108, the storage room such as a clothes closet (not shown), the loft, the underfloor, the hallway, the stair hall, and the entrance are non-living spaces.

Ventilation exhaust sections 126 provided in the bathroom 106, the restroom 107 and the lavatory 108, and a confluence chamber 110 having internal volume which is greater than a normal branch duct are connected each other through ducts 127. The confluence chamber 110 and a filter box 129 are connected to each other through a duct 128. The filter box 129 and a heat exchanging unit 111 having a total heat exchanging element 131 are connected to each other through a duct 130. The heat exchanging unit 111 and an exhaust port 113 provided in an outer wall 140 are connected to each other through a duct 135.

Although the confluence chamber 110 and the ventilation exhaust sections 126 provided in the restroom 107 and the lavatory 108 are connected to each other through the duct 127 in the embodiment, the confluence chamber 110 and the ventilation exhaust sections provided in the clothes closet or the kitchen may be connected to each other through a duct. In the embodiment, the confluence chamber 110 is provided on the ceiling of the bathroom 106, and the ventilation exhaust section 126 of the bathroom 106 and the ventilation exhaust port (described later) of the confluence chamber 110 are connected to each other such that air directly flows. However, the confluence chamber 110 may be provided under the ceiling of the bathroom 106, or may be provided under ceiling of the sanitaries 109 such as the restroom 107 and the lavatory 108, or the clothes closet or the kitchen, and the ventilation exhaust section of the bathroom 106 and a ventilation exhaust port (described later) of the confluence chamber 110 may be connected to each other through a duct. An outlet portion (not shown) of a ventilation fan (not shown) having an air blower provided in the bathroom 106, the restroom 107, the lavatory 108, the clothes closet or the kitchen, and a ventilation exhaust port (described later) of the confluence chamber 110 may be connected to each other through a duct. The confluence chamber 110 may be provided on the ceiling of the restroom 107, the lavatory 108, the clothes closet or the kitchen instead of the bathroom 106, and the ventilation exhaust section 126 and the ventilation exhaust port (described later) of the confluence chamber 110 may be connected to each other such that air directly flows.

An air-supply port 134 provided in the outer wall 140 and the filter box 132 are connected to each other through a duct 133. The filter box 132 and the heat exchanging unit 111 are connected to each other through a duct. The heat exchanging unit 111 and the outside air introducing port 121 of the return zone 101 are connected to each other through a duct.

In the above-described configuration, if the heat exchanging unit 111 is operated, a portion of return air after the air-conditioning flows into the sanitaries 109 from the exhaust portions 124 of the plurality of rooms 105 and from the bathroom 106 and the ventilation intake portions 125 such as the restroom 107 and the lavatory 108 which are other rooms through the hallway, the stair hall, the entrance and the ducts. Ventilation air which is mixed with air including moisture and smell of the sanitaries 109 flows into the confluence chamber 110 from the ventilation exhaust sections 126 through the duct 127 and the like, the moisture and smell are mixed in the confluence chamber 110 and attenuated, and the air passes through the filter box 129 in which a filter (not shown) is placed through the duct 128. According to this, moisture vapor of air and ventilation air such as the bathroom 106 in which chemical component included in the moisture vapor is reduced passes through the duct 130, and flows into the heat exchanging unit 111.

Air (outside air) from outdoor 112 is supplied from the air-supply port 134, the air passes through the duct 133 and the filter box 132 in which filter for purifying the outside air is placed, and the air flows into the heat exchanging unit 111 and is purified. In the heat exchanging unit 111, the ventilation air totally heat exchanges with the outside air by the total heat exchanging element 131, the ventilation air passes through the duct 135 and is exhausted into the outdoor 112 from the exhaust port 113.

The exhaust port 113 is provided at a position on a suction side of the heat exchanger 115 of the air conditioning outdoor machine 114. A partition wall 141 is provided between the air conditioning outdoor machine 114 and the outer wall 140 such that ventilation air from the exhaust port 113 is sucked into the heat exchanger 115 without leaking.

In the above-described configuration, outside air and ventilation air from the exhaust port 113 which is not recovered by the heat exchanging unit 111 join together, and the ventilation air is sucked into the heat exchanger 115.

Fresh air from the heat exchanging unit 111 and return air after the air-conditioning are air-conditioned by the air conditioning sections 102 in the return zone 101, the air-conditioned air is sent to the plurality of rooms 105 by the air-blowing sections 103, and the rooms 105 are air-conditioned. A portion after the air-conditioned is sent to the bathroom 106 and other rooms, and the air-conditioned air is replaced with air in the bathroom 106 and air in other rooms, and the air in the bathroom 106 and the air in the other rooms are exhausted, they join together and they are mixed with each other. According to this, relative humidity of air after the confluence becomes lower than relative humidity of air in the bathroom 106, the air after confluence flows into the heat exchanging unit 111, heat exchanges with outside air, and the air is exhausted into the outdoor 112. Hence, heat of the bathroom 106 during bath time can be recovered, dew condensation of the total heat exchanging element 131 is reduced, it is possible to prevent the lifetime of the total heat exchanging element 131 from being shortened, and mold in the bathroom 106 can be prevented. Therefore, it is possible to obtain the air conditioning ventilation system 100 capable of realizing comfortable and clean air while saving energy.

Further, the sanitaries 109, the clothes closet or the kitchen are the other rooms. Therefore, if air in the restroom 107, air in the lavatory 108, air in the clothes closet or air in the kitchen having moisture smaller than that in the bathroom 106 join together, proportion of smell or moisture to the confluence ventilation air is reduced, and the confluence air flows directly into the heat exchanging unit 111 without through the rooms 105. Hence, dew condensation of the total heat exchanging element 131 is reduced while recovering more heat, and it is possible to prevent the lifetime of the total heat exchanging element 131 from being shortened. Therefore, it is possible to obtain the air conditioning ventilation system 100 where smell or moisture does not move to the rooms 105.

Further, since ventilation air of the bathroom 106, the sanitaries 109, the clothes closet or the kitchen joins at the confluence chamber 110 having internal volume which is greater than that of a normal branch duct joins together. Hence, as the internal volume of the confluence chamber 110 is greater, the proportion of smell or moisture to the confluence ventilation air is reduced, dew condensation of the total heat exchanging element 131 becomes smaller, and it is possible to prevent the lifetime of the total heat exchanging element 131 from being shortened. Therefore, an air conditioning ventilation system 100 of excellent workability can be obtained.

If the internal volume of the confluence chamber 110 is greater, its effect also becomes greater, but working space is also restricted. Hence, the internal volume should be determined based on ventilation air volume of the entire house, ventilation air volume from the bathroom 106, normal average moisture of the sanitaries 109 such as the bathroom 106, the restroom 107 and the lavatory 108, and moisture when moisture is high during bath time in the bathroom 106. For example, when a floor area is 100 $m^2$ and a ceiling height is 2.5 m and the number of ventilation operations is 0.5 time/h, ventilation air volume for 24 hours is 125 $m^3$/h, air volumes of the bathroom 106, the restroom 107 and the lavatory 108 are 35 $m^3$/h, 45 $m^3$/h and 45 $m^3$/h, respectively, and when average moisture is 50% or less and moisture when moisture is high during bath time is 80% or greater, minimum internal volume of the confluence chamber 110 is 0.01 $m^3$ or greater, and is 0.016 $m^3$ in a state where a width is 250 mm*a depth is 250 mm*a height is 250 mm so that air volume of 35 $m^3$/h (0.01 $m^3$/S) which flows from the bathroom 106 into the confluence chamber 110 is exhausted out from the confluence chamber 110 one time for one second. As air volume of ventilation air of the sanitaries 109 having relatively low moisture with respect to air volume of high moisture ventilation air from the bathroom 106 is greater, volume of the confluence chamber 110 can be made smaller. As the air volume is smaller, it is necessary that the volume of the confluence chamber 110 is increased or a plurality of confluence chambers 110 are provided.

When the outlet portion of the bathroom ventilation fan (not shown) provided in the bathroom 106 is connected to the ventilation exhaust port (described later) of ventilation air from the bathroom 106 of the confluence chamber 110 through a duct, if the air blower (not shown) of the bathroom ventilation fan is operated, ventilation air from the bathroom 106 stably flows into the confluence chamber 110 irrespective of resistance of the duct and the bathroom 106 can be ventilated, and it is possible to select a place where the confluence chamber 110 is easily placed. Therefore, it is possible to obtain air conditioning ventilation system 100 of excellent workability.

Further, the confluence chamber 110 is provided in the ceiling (not shown) of the sanitaries 109 such as the bathroom 106, the restroom 107 and the lavatory 108, the clothes closet or the kitchen. Therefore, the ventilation exhaust sections 126 of the bathroom 106, the sanitaries 109, the clothes closet or the kitchen, and the ventilation exhaust port (described later) of the confluence chamber 110 can directly be connected to each other without through a duct. Hence, other ventilation fan (not shown) is unnecessary irrespective of resistance of a duct, and it is possible to stably ventilate the bathroom 106, the sanitaries 109, the clothes closet or the kitchen. Therefore, it is possible to obtain the air conditioning ventilation system 100 in which maintenance can be performed from under the ceiling of the bathroom 106, the sanitaries 109, the clothes closet or the kitchen.

Ability and the number of air conditioning sections 102 are selected based on an air-conditioning load of the building. In the return zone 101, outside air and return air are air-conditioned by the air conditioning sections 102 such that a temperature difference thereof falls within 5 K at the time of cooling operation and within 10 K at the time of heating operation with respect to a target temperature of each room 105. The air-conditioned air is sent from the air-intake portions 123 provided in the ceilings of the plurality of rooms 105 through the plurality of ducts 104 by the plurality of air-blowing sections 103. According to this, air in the rooms 105 is conditioned into comfortable temperature. Return air after the air-conditioning returns from the return ports 122 to the return zone 101 through the hallway, the stair hall, the entrance and the ducts from the exhaust portions 124 of the rooms 105.

Although air is sent to the rooms 105 from the air-blowing sections 103 through the plurality of ducts 104 in this embodiment, it may branched off halfway from one of the ducts 104 instead of the plurality of ducts 104. Air may be sent through an air-sending zone which is divided by building material instead of the ducts 104. Instead of sending air directly to the rooms 105, air may indirectly be sent to the rooms 105 through a space under the ceiling, the underfloor space, the hallway, the stair hall or the entrance. The bathroom 106, the sanitaries 109, the clothes closet or the kitchen is also included as a zone to be air-conditioned, and a zone which is desired to be air-conditioned aggressively may be selected.

In summer, even if cooled indoor air (ventilation air) and outdoor air (outside air) exchange heat by the heat exchanging unit 111, heat exchange can be performed only about 50% to 70% in normal heat in total. Therefore, ventilation air having smaller total heat than outdoor air (lower in temperature and moisture) is exhausted from the exhaust port 113, the air and the outdoor air join together, and the ventilation air becomes air having smaller total heat than the outdoor air, the air passes through the heat exchanger 115 which is a condenser, and refrigerant is made to totally exchange heat. In winter, even if heated indoor air (ventilation air) and outdoor air (outside air) exchange heat by the heat exchanging unit 111, heat exchange is performed only from 60% to 80% normally in total heat. Therefore, ventilation air of greater total heat than outdoor air (higher in temperature and moisture) is exhausted from the exhaust port 113, the air and the outdoor air join together, they become air having greater total heat than the outdoor air, the air passes through the heat exchanger 115 which is an evaporator, and refrigerant is made to exchange total heat.

By placing the exhaust port 113 which exhausts ventilation air discharged from the heat exchanging unit 111 to the outdoor 112 at the suction side position of the heat exchanger 115 in this manner, heat which could not be recovered by the heat exchanging unit 111 is further recovered, and a further energy-saving air conditioning ventilation system 100 can be obtained.

Although the exhaust port 113 is provided at the suction side position of the heat exchanger 115 in this embodiment, the duct 135 may be branched into two ducts, the exhaust port 113 may be provided at two position, and one of the exhaust ports 113 may be separated from the suction side position of the air conditioning outdoor machine 114. An opening/closing damper is connected to each of the exhaust ports 113. Depending upon an operation mode of the air conditioning sections 102, outdoor temperature and temperature of the ventilation air, the exhaust port 113 positioned at the suction side position of the air conditioning outdoor machine 114 and the exhaust port 113 separated from the suction side position of the air conditioning outdoor machine 114 may be used in a switching manner. For example, when the outdoor temperature is 25° C. and temperature of ventilation air is 30° C. and the outdoor temperature is higher than outside air temperature during a cooling operation at night in summer, a possibility that temperature of air which is heat exchanged and discharged by the heat exchanging unit 111 becomes 27° C. or higher is high. Therefore, by opening and closing the opening/closing damper and by exhausting ventilation air of 27° C. or higher from the exhaust port 113 which is separated from the suction side position of the air conditioning outdoor machine 114, temperature of air sucked into the heat exchanger 115 can be made as low temperature outside air of about 25° C., refrigerant in the heat exchanger 115 which is the condenser can be made to perform more heat exchange, and energy can further be saved.

Flow of ventilation air in the entire building is stirred and mixed by the air conditioning sections 102 together with fresh outside air and air-conditioned air and temperature and quality of the air become uniform in the return zone 101. Large volume of the mixed air is sent to living zones such as the rooms 105 by the plurality of air-blowing sections 103. A portion of air sucked by a person after the air-conditioning in the living zone moves to and joins with sanitary zone where moisture and smell are easily generated, and the air is exhausted to the outdoor 112 by the heat exchanging unit 111 in an amount of ventilation air volume or greater which is necessary as ventilation for 24 hours of building standards.

Hence, effective is extremely high if total air volume of the plurality of air-blowing sections 103 is greater than air volume of the air blower of the air conditioning sections 102, and if air volume of the air blower of the air conditioning sections 102 is greater than ventilation air volume of the heat exchanging unit 111.

It is preferable that air volume of the air-blowing sections 103 required for air-conditioning is at least 13 $m^3$/h or greater per 2.5 $m^3$ of the room and ideally, 20 $m^3$/h, and the sending air volume is adjusted in accordance with a size and a load of the room 105.

The optimal air-conditioning air volume Vq of the air blower of the air conditioning section 102 is 50% or less of the total sending air volume Vh of the air-blowing section 103, and the optimal air-conditioning air volume Vq is 70% or less at a maximum, and at this air volume, the air conditioning section 102 can exhibit its ability in accordance with an air-conditioning load.

Although it depends on a floor area, a ceiling height and an air-conditioning load of the building, if the air conditioning section 102 having cooling ability of 4 kW is installed under conditions that a floor area of the building is about 100 $m^2$ and a ceiling height thereof is 2.5 m, the optimal air-conditioning air volume Vq of the air blower of the air conditioning section 102 is 700 $m^3$/h when the total sending air volume Vh of the plurality of air-blowing sections 103 is 1200 $m^3$/h, and ventilation air volume of 24 hours of the heat exchanging unit 111 is 125 $m^3$/h when the number of ventilation operations is 0.5 times/h.

Since the total air volume of the plurality of air-blowing sections 103 is greater than air volume of the air conditioning sections 102 and ventilation air volume of the heat exchanging unit 111 as described above, it is possible to obtain the air conditioning ventilation system 100 in which air-conditioned air efficiently stirs air of the entire house, fresh air is introduced, air including $CO_2$, moisture and smell is exhausted.

Concerning ventilation air volume, the air volume may be increased as local ventilation when moisture is temporarily increased during bath time or when smell is increased if the restroom 107 is used and when a combustion type heating device is operated. For example, ventilation air volume is increased to 250 $m^3$/h with respect to ventilation air volume 125 $m^3$/h of 24 hours.

Although the rooms 105 are air-conditioned in the embodiment, other living spaces may be air-conditioned, and non-living spaces may be air-conditioned to rationalize the flow of conditioned air or to enhance the comfortableness. In this embodiment, outside air which is fresh air is introduced into a so-called clean zone of the room 105 (such as living room, bed room and reading room) where smell and moisture are less prone to be generated, the outside air is made to flow into so-called dirty zone such as the bathroom 106, the sanitaries 109, the clothes closet and the kitchen where smell and moisture are prone to be generated and thereafter, the outside air is exhausted to outdoor 112. However, the outside air which is fresh air may be introduced into the so-called clean zone of the room 105 (such as living room, bed room and reading room), or into the dirty zone such as the bathroom 106, the sanitaries 109, the clothes closet and the kitchen and thereafter, the outside air may be exhausted to the outdoor 112.

Although the ventilation exhaust sections 126 is provided in the bathroom 106, the restroom 107 and the lavatory 108 in the embodiment, the ventilation exhaust sections 126 may be provided in the plurality of rooms 105, other living spaces such as the kitchen, and non-living space such as the loft, the underfloor, the understair, the footpace of stairs and the return zone 101, and return air may flow into the heat exchanging unit 111 by ducts through the confluence chamber 110 and the filter box 129. Air including moisture or smell of the bathroom 106 and the sanitaries 109 joins with a larger amount of air including smaller moisture and smell from the living space, the non-living space and the return zone 101 through the confluence chamber 110, the filter box 129 and the duct. This is because efficiency of smell and moisture with respect to confluence ventilation air is further lowered, and the air flows into the heat exchanging unit 111. In such a case, before flowing into the heat exchanging unit 111, if a plurality of confluence chambers 110 are provided in a confluence portion of the duct which is connected to the ventilation exhaust sections 126, its effect is further enhanced.

The bathroom 106, the restroom 107 and the lavatory 108 which are the sanitaries 109 are different spaces in the embodiment, and each of them is provided with the ventilation exhaust section 126. However, even when the bathroom the restroom and the lavatory are one space as in certain foreign countries, or even when there is no bathtub in the bathroom and there exists only a shower, moisture and smell generated when housing equipment is used are exhausted and heat thereof is recovered. Therefore, this system is effective. In such a case, the number of the ventilation exhaust sections 126 may be one in accordance with distributions of air volume, moisture in a space and smell.

In the embodiment, the bathroom 106 as well as the sanitaries 109 are spaces where the exhausting operation is carried out as spaces in the house where moisture is high and smell is generated. However, even if the exhausting operation is mainly carried out in spaces such as the basement room, the underfloor, the drying room, the clothes closet and the sewage room where moisture is high and smell is easily generated, this system is effective.

FIG. 2 is a vertical sectional view of the sanitary of the building where the air conditioning ventilation system 100 is installed.

As shown in FIG. 2, the lavatory 108 and the restroom 107 are provided next to the bathroom 106, and the ceilings 152 are provided with the ventilation exhaust sections 126. The ventilation exhaust section 126 of the bathroom 106 is provided on a grill 150 connected to the ventilation exhaust port (not shown) of the confluence chamber 110 provided on the ceiling 152 of the bathroom 106, and the filter 151 is provided downstream of the ventilation exhaust section 126 of the grill 150 such that the filter 151 can be pulled in and out from the bathroom 106. The ventilation exhaust sections 126 and the confluence chamber 110 are connected to the duct 127 through the ventilation exhaust ports, and the confluence chamber 110 and the filter box 129 in which the filter is placed are connected to each other through the duct 128.

FIG. 3 is a vertical sectional view of the confluence chamber of the air conditioning ventilation system, and FIG. 4 is a bottom view of the confluence chamber.

As shown in the drawings, a bottom surface 153 of the confluence chamber 110 is provided with the grill 150 including the ventilation exhaust sections 126 of ventilation air from the bathroom 106. The filter 151 which removes dust, moisture and chemical component included in ventilation air is provided downstream of the ventilation exhaust section 126 of the grill 150 such that the filter 151 can be pulled in and out from a down side. A ventilation exhaust port 154 which is an inflow port into the confluence chamber 110 is provided downstream of the filter 151. The filter 151 is illustrated in FIG. 4 such that it is laterally pulled in and out, but the filter 151 may be pulled in and out in other directions, and the filter 151 may be pulled out downward and it may be fitted in upward. The duct 127 connected to the ventilation exhaust sections 126 of ventilation air from the restroom 107 and the lavatory 108 is connected to ventilation exhaust ports 156 provided on both the side surfaces 155 of the confluence chamber 110. The filter box 129 and an outlet portion 158 provided on a rear surface 157 which is a portion of the side surface 155 of the confluence chamber 110 are connected to each other through a duct.

According to the above-described configuration, when ventilation air from the bathroom 106 passes through a small gap such as mesh (not shown) of the filter 151, dust in the ventilation air or large moisture vapor attaches to the filter 151 and according to this, dust or moisture in the ventilation air or chemical component included in the ventilation air, and smell are removed. The ventilation air is mixed with ventilation air from the restroom 107 and the lavatory 108 in confluence chamber 110, moisture and smell from the bathroom 106 are attenuated, and the air flows into the filter box 129 from the outlet portion 158 of the confluence chamber 110 through a duct.

It is possible to obtain the air conditioning ventilation system 100 capable of preventing large moisture vapor in the ventilation air from the bathroom 106 and chemical component included therein from flowing into the heat exchanging unit 111 by the filter 151.

A size, a thickness, an area and material of the mesh of the filter 151 can appropriately be changed into optimal values depending upon an amount of air which passes through the filter 151, dust, moisture vapor and chemical component included in the air.

The filter 151 can be taken out from below the confluence chamber 110. Therefore, when dust, moisture vapor and chemical component included therein largely attach to the filter 151, the filter 151 can be taken out and cleaned, and performance of the filter 151 can be maintained.

According to this, it is possible to obtain the air conditioning ventilation system 100 in which the filter 151 can easily be maintained from the bathroom 106.

The confluence chamber 110 is provided therein with a wall portion 160 at a halfway location of a flow path of ventilation air to the outlet portion 158 after confluence with a mixing portion 163. The wall portion 160 extends to both the side walls 155 of the confluence chamber 110 and includes a gap 162 between the wall portion 160 and the ceiling surface 161. In the mixing portion 163, ventilation air from the bathroom 106, ventilation air from the restroom 107 and ventilation air from the lavatory 108 join together and are mixed. The mixing portion 163 is provided between the ventilation exhaust ports 154, 156 and the wall portion 160 which exhaust air from the sanitaries 109.

In the above-described configuration, it is possible to obtain the air conditioning ventilation system 100 in which high humidity ventilation air of the bathroom 106 during bath time is mixed with ventilation air of other sanitaries 109 and becomes low humidity ventilation air, and the ventilation air flows into the heat exchanging unit 111.

Further, relatively large moisture vapor in the ventilation air and chemical component included in the ventilation air which passes through the filter 151 when and after the ventilation air joins in the mixing portion 163 collide against the wall portion 160, stays below the wall portion 160 due to gravity force and the ventilation air cannot pass over the gap 162. According to this, it is possible to obtain the air conditioning ventilation system 100 capable of preventing relatively large moisture vapor in the ventilation air and chemical component included therein after confluence from flowing into the heat exchanging unit 111.

It is preferable that areas of the wall portion 160 and the gap 162 are determined by moisture of passing air volume and moisture of passing air.

The wall portion 160 includes a plurality of small holes 170.

In the above-described configuration, when confluence ventilation air passes through the wall portion 160, relatively small moisture vapor of the ventilation air attaches to a peripheral wall (not shown) of the small holes 170 of the wall portion 160. Since the ventilation air passes through the small holes 170 while reducing moisture in the ventilation air, pressure loss is reduced and ventilation air volume is increased.

According to this, it is possible to prevent moisture vapor of air after confluence and chemical component included therein from flowing into the heat exchanging unit 111, and it is possible to obtain the air conditioning ventilation system 100 which maintains stable ava having small pressure loss.

It is preferable that a shape, an area and the number of small holes 170 are determined based on moisture and pressure loss of ventilation air volume and passing air.

A drain pan 165 is provided at lower portions of the confluence chamber 110 and the wall portion 160. The drain pan 165 can be attached and detached in a state where the grill 150 is detached from the side of the bathroom 106.

In the above-described configuration, moisture vapor which attaches to the wall portion 160 or the small holes 170 becomes drain water 164, the drain water 164 is collected in the drain pan 165 provided at the lower portion of the wall portion 160 and as a result, amounts of moisture included in ventilation air and chemical component included therein are reduced. Since the drain water is collected in the drain pan 165, it is possible to prevent the drain water from dropping on the bathroom 106, and maintenance can be performed from the side of the bathroom 106. If the drain water 164 is collected, it is possible that the drain pan 165 is detached, the drain water 164 is discarded, and the drain pan 165 can again be attached. A drain hose (not shown) can be connected to the drain pan 165, overflow is prevented and water can be discharged continuously.

The ventilation exhaust ports 154 and 156 of ventilation air from the sanitaries 109 of the confluence chamber 110 include an air volume adjusting portions 171 which slide two of three flat plates.

In the above-described configuration, the flat plates are slid and areas of the ventilation exhaust ports 154 and 156 are changed. According to this, ventilation air volume can be adjusted to a value corresponding to necessary ventilation air volume of the sanitary 109 and moisture and smell of ventilation air. Therefore, it is possible to obtain the air conditioning ventilation system 100 in which moisture and smell of the sanitary 109 are reduced while ventilating the entire house, and an amount of moisture which flows into the heat exchanging unit 111 during bath time is reduced.

The air volume adjusting portions 171 can manually be adjusted from the bathroom 106 in the sliding manner composed of the several flat plates in the embodiment, but the air volume adjusting portions 171 may be moved by a motor. The air volume adjusting portions 171 may be adjusted by a rotation angle of a damper and may similarly be moved by a motor.

The ventilation air volume corresponding to the necessary ventilation air volume of the sanitary 109, and moisture and smell of ventilation air, e.g., air volume of the entire building for 24 hours is 125 $m^3/h$ based on its floor area, when normally bathroom 55 $m^3/h$, restroom 35 $m^3/h$ and the lavatory 35 $m^3/h$, the bathroom 35 $m^3/h$, the restroom 45 $m^3/h$, and the lavatory 45 $m^3/h$. This is because since ventilation air becomes high temperature and high moisture in the bathroom 106, ventilation air volume of the bathroom 106 is set equal to or less than ventilation air volumes of the restroom 107 and the lavatory 108.

The heat exchanger ventilation air volume of the bathroom 106 is set equal to or less than the ventilation air volume of the other sanitary 109 by the air volume adjusting portions 171. Therefore, it is possible to obtain the air conditioning ventilation system 100 in which an amount of moisture during bath time which flows into the heat exchanging unit 111 is further reduced.

A distance between the ventilation exhaust port 154 and the outlet portion 158 in the confluence chamber 110 is longer than a distance between the ventilation exhaust ports 156 and the outlet portion 158.

In the above-described configuration, ventilation air from the sanitary 109 other than the bathroom 106 flows faster than ventilation air from the bathroom 106 and smoothly reaches the outlet portion 158. Therefore, it is possible to obtain the air conditioning ventilation system 100 in which it is easy to adjust such that moisture vapor in the ventilation air from the bathroom 106 is reduced and air volume from the bathroom 106 is reduced.

A ceiling 152 of the bathroom 106 includes the confluence chamber 110, an ventilation exhaust port 154 includes the bottom surface 153 of the confluence chamber 110, the ventilation exhaust ports 156 is provided on both the side surfaces 153 of the confluence chamber 110 and the outlet portion 158 is provided on the rear surface 157.

In the above-described configuration, ventilation air including much moisture from the bathroom 106 flows into the confluence chamber 110 from below, and ventilation air from the restroom 107 and the lavatory 108 having relatively low moisture joins up such that inflow of ventilation air from the bathroom 106 from both sides of the confluence chamber 110 is blocked. Hence, even if high humidity air volume of the bathroom 106 during bath time flows into the confluence chamber 110, since wind speed partially becomes slow, moisture vapor is collected at a lower portion due to gravity force and the moisture vapor cannot pass over the wall portion 160. Therefore, it is possible to obtain the air conditioning ventilation system 100 capable of lowering moisture of confluence air discharged from the outlet portion 158.

The bottom surface 153 of the confluence chamber 110 is provided with the ventilation exhaust port 154, both the side surfaces 155 of the confluence chamber 110 is provided with the ventilation exhaust ports 156 and the rear surface 157 is provided with the outlet portion 158 in this embodiment, but if flow of ventilation air is rational, the ventilation exhaust ports 154 and 156 and the outlet portion 158 may be placed on any of the bottom surface 153 of the confluence chamber 110, four side surfaces 155 (including rear surface 157) and the ceiling surface 161. The number of the ventilation exhaust ports 154 and 156 and the outlet portion 158 may be increased or reduced in accordance with the number of ventilation exhaust sections 126 of spaces to be connected and air volume.

In the embodiment, the bottom surface 153 of the confluence chamber 110 is provided with the ventilation exhaust sections 126 of ventilation air from the bathroom 106, and the duct 127 connected to the ventilation exhaust sections 126 of ventilation air from the restroom 107 and the lavatory 108 is connected to the ventilation exhaust ports 156 provided on both the side surfaces 155 of the confluence chamber 110. However, in a housing, as places where moisture is high and smell is generated, there are the basement room, the underfloor, the drying room, the clothes closet, and the sewage room other than the bathroom 106 and the sanitaries 109. Even if the ventilation exhaust sections of the spaces are connected to the bottom surface 153 and both the side surfaces 155 of the confluence chamber 110, this system is effective. The air volume adjusting portions 171 may be adjusted such that ventilation air volume becomes values corresponding to necessary ventilation air volume of the rooms connected to the confluence chamber 110, moisture of the ventilation air and smell.

The filter box 129 is provided under the ceiling between the ducts 128 and 130 which connect the confluence chamber 110 and the heat exchanging unit 111 to each other. An inspection port (not shown) is provided below the filter box 129 so that the filter can be taken out. It is preferable that a size, a thickness, an area and material of mesh of this filter are optimally changed so that dust which is finer than filter 151 of the confluence chamber 110, moisture vapor, and chemical component included therein can be removed. If significant amounts of dust, moisture vapor and chemical component can be removed by the filter 151, the filter may be equal to the filter 151 or the filter may not be provided.

The filter can be detached from below of the filter box 129 through the inspection port, when much dust, moisture vapor and chemical component included therein attach to the filter, the filter can be detached and cleans, and performance can be maintained.

According to this, it is possible to obtain the air conditioning ventilation system 100 in which ventilation air having lower moisture and smaller chemical component flows into the heat exchanging unit 111 and maintenance of the filter can easily be performed from the filter box 129.

FIG. 5 are horizontal sectional views of a heat exchanging unit of the system, wherein FIG. 5(*a*) shows when a heat exchanging ventilation mode is carried out, and FIG. 5(*b*) shows when a normal ventilation mode is carried out.

As shown in drawings, the heat exchanging unit 111 is provided therein with a total heat exchanging element 131 which totally exchanges heat of fresh outside air and ventilation air after air-conditioning. The filter box 132 which sucks outside air and an outside air inlet portion 180 are connected to each other through a duct, an outside air outlet portion 182 and the outside air introducing port 121 of the return zone 101 are connected to each other through a duct, and a wind passage (not shown) between the outside air inlet portion 180 and the outside air outlet portion 182 is provided with the total heat exchanging element 131 and an air-supply air blower 181 in this order.

On the other hand, the filter box 129 which sucks ventilation air and a ventilation air inlet portion 184 are connected to each other through the duct 130, the ventilation air outlet portion 186 and the exhaust port 113 for discharging ventilation air are connected to each other through the duct 135, and a wind passage (not shown) between the ventilation air inlet portion 184 and the ventilation air outlet portion 186 are provided with the bypass damper 187, the total heat exchanging element 131 and the exhausting air blower 185 in this order.

In the above-described configuration, outside air purified by the filter box 132 passes through a duct and flows into the heat exchanging unit 111 from the outside air inlet portion 180. Thereafter, outside air is introduced into the return zone 101 from the outside air outlet portion 182, the duct and the outside air introducing port 121 by the air-supply air blower 181 through the total heat exchanging element 131.

On the other hand, ventilation air after air-conditioning passes through the filter box 129 and the duct 130, and flows into the heat exchanging unit 111 from the ventilation air inlet portion 184. Thereafter, the ventilation air passes through the total heat exchanging element 131, and is discharged from the exhaust port 113 into the outdoor 112 through the ventilation air outlet portion 186 and the duct 135 by the exhausting air blower 185.

A bypass wind passage 189 is provided between the ventilation air inlet portion 184 and the ventilation air outlet portion 186 in parallel to a wind passage which passes through the total heat exchanging element 131. The bypass damper 187 is rotated by a motor 188. The bypass damper 187 can switch between a heat exchanging mode in which ventilation air passes through the total heat exchanging element 131 and the normal ventilation mode in which ventilation air bypasses the total heat exchanging element 131 and passes through the bypass wind passage 189.

In this manner, the heat exchanging unit 111 switches between the normal ventilation mode in which ventilation air bypasses the total heat exchanging element 131 by the bypass damper 187 and the heat exchanging mode in which the heat exchanging unit 111 makes ventilation air bypass the total heat exchanging element 131 by the bypass damper 187. According to this, it is possible to obtain the air conditioning ventilation system 100 in which the heat exchanging unit 111 is operated in the normal ventilation mode during bath time in winter, and the lifetime of the system can be prevented from being shorted by dew condensation onto the total heat exchanging element 131.

A temperature detecting section 190 and a moisture detecting section 191 exists near the ventilation air inlet portion 184 of the heat exchanging unit 111, and an outside air temperature detecting section 192 exists near the outside air inlet portion 180. The system includes a control section 193 which switches the bypass damper 187 between the normal ventilation mode and the heat exchanging ventilation mode by the motor 188 depending upon detection values of the temperature detecting section 190, the moisture detecting section 191 and the outside air temperature detecting section 192.

The control section 193 normally operates the heat exchanging unit 111 in the heat exchanging mode, passes ventilation air through the total heat exchanging element 131 and exchanges heat with outside air. During bath time in winter, when temperature detected by the outside air temperature detecting section 192 is 10° C. or lower and temperature detected by the temperature detecting section 190 20° C. or higher and moisture detected by the moisture detecting section 191 is 70% or higher, if the control section 193 heat-exchanges the ventilation air and the outside air by the total heat exchanging element 131, the control section 193 determines that dew condensation is prone to be generated on the total heat exchanging element 131, the control section 193 controls the motor 188, and switches the bypass damper 187 from the heat exchanging mode to the normal ventilation mode. According to this, ventilation air having much moisture bypasses the total heat exchanging element 131, the ventilation air passes through the bypass wind passage 189, dew condensation of the total heat exchanging element 131 is prevented, and lifetime of the total heat exchanging element 131 is prevented from being shortened. At night in summer, when temperature detected by the outside air temperature detecting section 192 is 25° C. or lower and temperature detected by the temperature detecting section 190 is 25° C. or higher, if the control section 193 heat-exchanges between ventilation air and outside air by the total heat exchanging element 131, temperature of outside air rises, energy is superfluously spent and comfortableness is deteriorated. Hence, the motor 188 is controlled so that ventilation air and outside air do not heat-exchange, the bypass damper 187 is switched from the heat exchanging mode to the normal ventilation mode, ventilation air having temperature higher than that of the outside air bypasses the total heat exchanging element 131, and the ventilation air passes through the bypass wind passage 189. According to this, it is possible to prevent temperature of outside air in the total heat exchanging element 131 from rising, energy is saved and comfortableness is enhanced.

In this manner, it is possible to obtain the convenient air conditioning ventilation system 100 in which the normal ventilation mode and the heat exchanging ventilation mode can automatically be switched.

Although the temperature detecting section 190 is provided in the embodiment, the temperature detecting section 190 may not be provided, and when temperature detected by the outside air temperature detecting section 192 is 10° C. or lower and moisture detected by the moisture detecting section 191 is 80% or higher, it may be determined that the dew condensation is prone to be generated on the total heat exchanging element 131, and the mode may be switched to the normal ventilation mode.

A remote controller (not shown) may be provided, and the heat exchanging mode and the normal ventilation mode may be switched manually.

Further, temperature detected by the outside air temperature detecting section 192 is 10° C. or lower, or concrete temperature and moisture are just one examples. Optimal temperature and moisture are changed depending upon configuration of the system and installation environment. Therefore, a user may appropriately change the temperature or moisture by a sliding switch (not shown) by the remote controller.

A structure and material of the total heat exchanging element 131 in the embodiment should be selected such that moisture of the ventilation air discharged into the outdoor 112 appropriately moves into the outside air which is introduced into the building but smell is less prone to move. For example, it is preferable that the total heat exchanging element 131 includes adsorbent material such as activated carbon. If the total heat exchanging element 131 is composed of moisture transmission film having gas barrier property through which air or smell cannot pass, e.g., thin film transmission resin made of nanofiber as chief material, air can be discharged such that temperature and moisture are recovered and smell and miscellaneous bacteria do not return.

When the total heat exchanging element 131 is used under circumstances that lot of dew condensation and smell exist, heat exchanging efficiency is inferior, and drainage work of drain water 164 is required, but a sensible heat exchanging element may be used instead of the total heat exchanging element 131. Even if the sensible heat exchanging element is used, it is possible to recover sensible heat of the bathroom 106 which is conventionally exhausted as it is, and since dew condensation is reduced by reduction in humidity, deterioration is prevented and lifetime becomes long.

INDUSTRIAL APPLICABILITY

An air conditioning ventilation system of the present invention is a system capable of creating efficient flows of air-conditioning and ventilation of an entire building. If humidity in a sanitary, a basement room, a drying room and a sewage room is high and smell is generated in the building, the present invention can be applied to air-conditioning ventilation of buildings such as commercial facilities and hospitals having a large floor area.

EXPLANATION OF SYMBOLS

100 air conditioning ventilation system
101 return zone
102 air conditioning section
103 air-blowing section
104 duct
105 room
106 bathroom
107 restroom
108 lavatory
109 sanitary
110 confluence chamber
111 heat exchanging unit
112 outdoor
113 exhaust port
114 air conditioning outdoor machine
115 heat exchanger
120 suction port
121 outside air introducing port
122 return port
123 air-intake portion
124 exhaust portion
125 ventilation intake portion
126 ventilation exhaust section
127 duct
128 duct
129 filter box
130 duct
131 total heat exchanging element
132 filter box
133 duct
134 air-supply port
135 duct
140 outer wall
141 partition wall
150 grill
151 filter
152 ceiling
153 bottom surface
154 ventilation exhaust port
155 side surface
156 ventilation exhaust port
157 rear surface
158 outlet portion
160 wall portion
161 ceiling surface
162 gap
163 mixing portion
164 drain water
165 drain pan
170 small holes
171 air volume adjusting portion
180 outside air inlet portion
181 air-supply air blower
182 outside air outlet portion
184 ventilation air inlet portion
185 exhausting air blower
186 ventilation air outlet portion
187 bypass damper

188 motor
189 bypass wind passage
190 temperature detecting section
191 moisture detecting section
192 outside air temperature detecting section
193 control section

The invention claimed is:

1. An air conditioning ventilation system comprising:

air-intake portions and exhaust portions respectively provided in a plurality of rooms of a building;

air-blowing sections for sending wind to the air-intake portions; and a return zone where air discharged from the exhaust portions by the air-blowing sections joins up; wherein the air-blowing sections and an air conditioning section are placed in the return zone, a bathroom and other rooms include ventilation intake portions and ventilation exhaust sections to ventilate these room for exchanging air, a confluence chamber where ventilation air from the other rooms and ventilation air from the bathroom join together and are attenuated, the ventilation air from the bathroom being ventilated by a ventilation exhaust section, and the ventilation exhaust section and the confluence chamber being connected by at least a first duct, the system includes a heat exchanging unit which heat-exchanges confluence air of the other rooms and the bathroom and outside air, and discharges the confluence air to outside of the building, the confluence chamber and the heat exchanging unit being connected by a second duct, and the outside air after the outside air exchanges heat with the confluence air is introduced into the return zone.

2. The air conditioning ventilation system according to claim 1, wherein a sanitary such as a restroom and a lavatory, a storage room such as a clothes closet or a kitchen are the other rooms.

3. The air conditioning ventilation system according to claim 1, wherein a ceiling of the bathroom or the other room is provided with the confluence chamber.

4. An air conditioning ventilation system comprising:

air-intake portions and exhaust portions respectively provided in a plurality of rooms of a building;

air-blowing sections for sending wind to the air-intake portions; and a return zone where air discharged from the exhaust portions by the air-blowing sections joins up; wherein the air-blowing sections and an air conditioning section are placed in the return zone, a bathroom includes ventilation intake portions and ventilation exhaust sections to ventilate the bathroom for exchanging air;

the system includes a heat exchanging unit which heat-exchanges ventilation air, and filtered or attenuated air of the bathroom and outside air, and discharges the ventilation air, and filtered or attenuated air to outside of the building, and the outside air after the outside air exchanges heat with the ventilation air is introduced into the return zone.

5. The air conditioning ventilation system according to claim 4, wherein the heat exchanging unit includes a normal ventilation mode for making the ventilation air bypass a heat exchanging element, and a heat exchanging ventilation mode for making the ventilation air pass through the heat exchanging element, by a bypass damper.

6. An air conditioning ventilation system comprising:

air-intake portions and exhaust portions respectively provided in a plurality of rooms of a building;

air-blowing sections for sending wind to the air-intake portions; and a return zone where air discharged from the exhaust portions by the air-blowing sections joins up; wherein the air-blowing sections and an air conditioning section are placed in the return zone, other rooms include ventilation intake portions and ventilation exhaust sections to ventilate these room for exchanging air, the system includes a heat exchanging unit which heat-exchanges ventilation air, and filtered or attenuated air from the other rooms and outdoor air and discharges the ventilation air to outside of the building, the outside air after the outside air exchanges heat with the ventilation air is introduced into the return zone, an exhaust port for discharging the ventilation air, and filtered or attenuated air discharged from the heat exchanging unit to outside of the room is provided at a suction side position of a heat exchanger of an air conditioning outdoor machine.

* * * * *